United States Patent [19]

Rothlisberger

[11] 4,178,154

[45] Dec. 11, 1979

[54] LIGHT SYNTHETIC FUEL

[76] Inventor: Henri Rothlisberger, 32 Blvd. Edouard VII, Beaulieu sur Mer, France

[21] Appl. No.: 655,229

[22] Filed: Feb. 4, 1976

[30] Foreign Application Priority Data

Feb. 5, 1975 [FR] France ..... 75 04397

[51] Int. Cl.[2] ..... C10L 1/02

[52] U.S. Cl. ..... 44/53; 44/56

[58] Field of Search ..... 127/37; 195/44, 33; 44/53, 56

[56] References Cited

U.S. PATENT DOCUMENTS

| | | | |
|---|---|---|---|
| 12,069 | 12/1902 | Classen | 127/37 |
| 2,132,039 | 10/1938 | Müller | 195/44 |
| 2,209,204 | 7/1940 | McCulloch et al. | 44/56 |
| 2,409,746 | 10/1946 | Evan et al. | 44/56 |
| 2,417,801 | 3/1947 | Weizmann | 195/33 |
| 3,912,463 | 10/1975 | Kozlowski et al. | 44/56 |

OTHER PUBLICATIONS

"Industrial Microbiology", Prescott et al., 3rd Ed., 1959, pp. 285 and 286.

*Primary Examiner*—Winston A. Douglas
*Assistant Examiner*—Y. Harris-Smith

[57] ABSTRACT

A method of manufacturing from cellulose a light fuel for internal combustion engines. The source of the cellulose can be the common cellulosic materials such as cereal straw, maize husks, wood waste, sawdust, paper or packing wood. The raw material is crushed, then composted and processed to separate the lignin from the cellulose. The cellulose is acid hydrolized to a glucose, placed in a basic medium and fermented to produce an isopropyl alcohol which in turn is converted to isopropyl ether. The isopropyl ether is combined with a branched lower alkane, preferably isoctane and subjected to a cobalt catalyst, preferably $Co(AlO_2)_2$ or $Co(CH_3CO_2)_2.4H_2O$. The catalysis is carried out at about 500° C., at a pressure of about 50 atms., in an inert atmosphere for about 10 to 20 seconds. The resultant product can be used as an internal combustion engine fuel.

1 Claim, No Drawings

LIGHT SYNTHETIC FUEL

DESCRIPTION OF THE PREFERRED EMBODIMENTS

The invention relates to a light synthetic fuel for internal combustion engines, derived from a cellulosic raw material.

The cellulose source can be cereal straw, esparto, maize husks, wood waste, sawdust, paper, packing wood and the like. The raw material is crushed, composted and treated to solubilize the lignin component of the raw material. The cellulose component remains insoluble during the treatment and accordingly, the two components which occur together in plants, can be readily separated.

The cellulose constituent is acid hydrolyzed to produce a glucose as illustrated in the equation:

$$(C_6H_{10}O_5)_n + n(H_2O \xrightarrow{acid} n(C_6H_{12}O_6)$$

The glucose is then placed in a basic medium such as sodium carbonate and then amenable to fermentation, which is preferably carried out at a temperature in the range between 75° and 90° C. at a pressure in the range from 30 to 50 bars. It is noted that a bar is equal to 0.987 atmospheres and within the criticality range of the invention; the two units of measure are essentially equal and may be used interchangeably. The fermentation produces 100° proof isopropyl alcohol which is converted to isopropyl ether, using conventional, well known methods.

The isopropyl ether, like the prior art alcohol-based fuels, produces unsatisfactory results. The isopropyl ether is excessively volatile to be a satisfactory fuel. Aside from methane, alkane stabilizers do not provide adequate results. The straight chain alkanes, in particular n-heptane have proven to be inoperative in the present system. By way of contrast, branched lower alkanes, preferably iso-octane, in association with the isopropyl ether can be mixed with air and subjected to a high compression ratio without undergoing spontaneous ignition; while iso-octane and the close lower alkanes are operative, best results can be obtained with trimethyl 2,2,4 pentane,

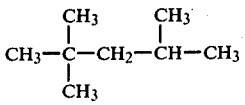

It has been found that to produce a commercially acceptable fuel, it is indispensable to pass the fuel mixture through a catalyst. The cobalt salts, cobalt aluminate, $Co(AlO_2)_2$ and cobalt acetate, $Co(CH_3CO_2)_2.4H_2O$ have been found to provide the desired critical end result. The use of either acid resins or the ion exchange phenolsulfonic aldehyde resin sold under the trademark Amberlite, by Rohm & Hass Co., is extremely advantageous. Although these materials are high in price, they are exceptionally durable in use, thus offsetting the price disadvantage.

It has been found that a remarkably porous body can be derived from scrap or waste from the treatment of bauxite. The surface area of the porous body is on the order of 250 to 600 $m^2$ per 100 kg. The material, $4(SiO_2) - Al_2O_3.H_2O$ serves as a substitute or carrier for the cobalt catalyst which is deposited on the porous carrier using known techniques.

The catalysis is carried out at a temperature on the order of 500° C., at a pressure on the order of 50 atms, in an inert atmosphere. The use of nitrogen to provide the inert atmosphere has been found to provide the desired results. The time period for the catalysis is on the order of from 10 to 20 seconds.

What is claimed:

1. A method of manufacturing a light fuel for internal combustion engines comprising the steps of crushing and composting a cellulose to separate the lignin therefrom, subjecting said lignin-free cellulose to acid hydrolysis to form a glucose, mixing said glucose with a basic medium and fermenting said mixture at a pressure on the order of 30 to 50 atms., and a temperature on the order of 75° to 90° C. to form isopropyl alcohol, converting said isopropyl alcohol to isopropyl ether, combining said isopropyl ether with a minor amount of a isoctane and subjecting said combination to a cobalt catalyst, selected from the group consisting of cobalt aluminate or/and cobalt acetate, said catalysis being carried out at about 500° C. at a pressure of about 50 atms. and an inert atmosphere for about 10 to 20 seconds.

* * * * *